United States Patent [19]

McClellan et al.

[11] Patent Number: 4,488,133

[45] Date of Patent: Dec. 11, 1984

[54] CONTACT ASSEMBLY INCLUDING SPRING LOADED CAM FOLLOWER OVERCENTER MEANS

[75] Inventors: David P. McClellan, Westminster; Gerald R. Duble, New Windsor; William H. Hofferberth, Finksburg, all of Md.

[73] Assignee: Siemens-Allis, Inc., Atlanta, Ga.

[21] Appl. No.: 479,366

[22] Filed: Mar. 28, 1983

[51] Int. Cl.[3] ..... H01H 61/02

[52] U.S. Cl. ..... 335/16; 335/195; 335/190

[58] Field of Search ..... 335/16, 147, 194, 190, 335/195

[56] References Cited

U.S. PATENT DOCUMENTS

| | | | |
|---|---|---|---|
| 2,618,716 | 11/1952 | Boller et al. | 335/6 |
| 2,677,734 | 5/1954 | Boller et al. | 335/6 |
| 3,005,073 | 10/1961 | Reiss et al. | 335/16 |
| 3,384,845 | 5/1968 | Johnson et al. | 335/16 |
| 3,549,843 | 12/1970 | Wilson | 200/153 |
| 3,588,763 | 6/1971 | Heft | 335/16 |
| 3,774,126 | 11/1973 | Araki | 335/9 |
| 4,087,769 | 5/1978 | Di Marco et al. | 335/16 |
| 4,144,513 | 3/1979 | Shaffer et al. | 335/46 |
| 4,167,659 | 9/1979 | Yamanaka et al. | 200/153 E |
| 4,197,519 | 4/1980 | Grenier | 335/175 |

*Primary Examiner*—J. D. Miller
*Assistant Examiner*—George Andrews
*Attorney, Agent, or Firm*—F. W. Powers; J. L. James

[57] ABSTRACT

A so-called blow-off type current limiting circuit breaker is constructed with a contact pressure spring that also holds the contact arm in open contact position when the contacts are blown open by electrodynamic forces. A multi-section cam means transmits contact opening and closing forces produced by a spring powered overcenter toggle type operating mechanism to the movable contact arm. A follower on the latter is biased into engagement with the cam means by the contact pressure spring. The cam means is so constructed that during contact blow-off the movable contact arm requires relatively little motion to move overcenter in the opening direction. One section of the cam means is constructed so that when the contact arm moves overcenter in the opening direction during contact blowoff, speed of the contact arm is controlled to an extent that contact rebound does not become a problem. Another section of the cam means is constructed so that with the line of action of the contact pressure spring extending lengthwise of the contact arm, a strong component of force is developed transverse to the length of the contact arm to urge the contacts into butt-type engagement.

11 Claims, 13 Drawing Figures

CONTACT ASSEMBLY INCLUDING SPRING LOADED CAM FOLLOWER OVERCENTER MEANS

This invention relates to current limiting molded case circuit breakers in general and more particularly relates to means for controlling the movable contact during blow-off under severe fault current conditions.

For molded case circuit breakers connected in circuits that are capable of delivering relatively high currents, say 50,000 amps at 480 volts, conventional spring powered trip-free contact operating mechanisms do not respond quickly enough to prevent permanent damage to the circuit breaker when it is subjected to severe fault current conditions. Because of this, the prior art has provided circuit breaker constructions in which electrodynamic blow-off forces developed as a result of severe fault currents will act to separate the circuit breaker contacts even before typical overload current sensing devices release the contact operating mechanism for opening the circuit breaker. In effect, fast separation of the circuit breaker contacts as a result of electrodynamic forces serves to limit the magnitude of the fault current to a value that will not cause permanent damage to the circuit breaker. An example of this type of current limiting circuit breaker is found in the B. DiMarco and A. J. Kralik copending U.S. patent application (RMD-1104) Ser. No. 256,305, filed Apr. 23, 1981, entitled "Electromagnetically Actuated Anti-Rebound Latch". In particular, in the aforesaid copending application Ser. No. 256,305, under severe fault current conditions the movable contact is driven open rapidly by electrodynamic forces. In opening under very severe fault current conditions there is great danger of contact rebound to closed position because the overcenter position for the blowoff mechanism is so close to the full open position for the movable contact arm. Additionally, the movable contact arm must move a substantial distance to reach the overcenter position for the blowoff mechanism. The latter creates problems in utilizing the springs of the blowoff mechanism to obtain pressure between the butting main contacts. The problem is accentuated at higher current ratings since more contact pressure is required, so that when utilizing prior art construction, springs of greater force are required. Another prior art example of a blowoff-type current limiting mechanism wherein the movable contact is driven overcenter during blowoff, is disclosed in U.S. Pat. No. 3,663,905, issued May 16, 1972 to F. W. Kussy and G. E. Heberlein, Jr. for a "Contact Bridge System For Circuit Breaker".

This invention solves the foregoing problems of the prior art by providing a multi-section cam means engaged by a spring-biased follower on the contact arm. The follower is driven along the cam means as the contact arm moves toward open circuit position during contact blowoff. As will hereinafter be seen, the cam sections are formed in a manner such that relatively little motion of the contact arm during contact blowoff brings the arm overcenter in the opening direction. The cam is appropriately shaped so that as the contact arm moves beyond the open circuit position inertia will not develop to an extent that rebound becomes a problem so that anti-rebound latches are not required.

Accordingly, the primary object of the instant invention is to provide a novel improved current limiting circuit breaker.

Another object is to provide a circuit breaker of this type constructed so that during blow-off the contact arm reaches an overcenter position after relatively little motion in the Off direction.

Still another object is to provide a current limiting circuit breaker of this type that does not require a latch to prevent contact arm rebound during contact blowoff.

A further object is to provide a circuit breaker of this type that includes a novel cam means to control movement of the movable contact arm especially during contact blowoff.

These objects, as well as other objects of this invention shall become readily apprent after reading the following description of the accompanying drawings, in which.

Figure 9A:
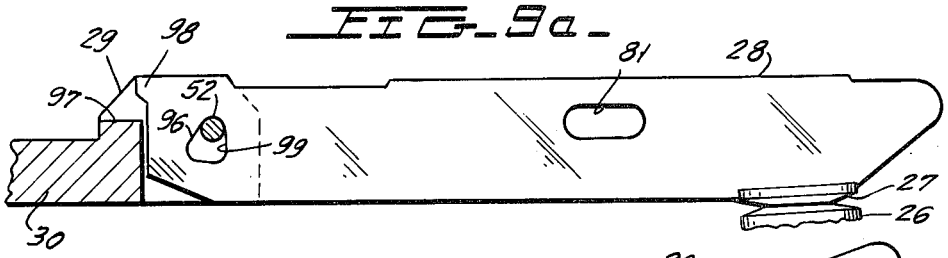

FIGS. 9*a* through 9*e* are side elevations of the movable contact arm in different positions thereof. In FIG. 9*a* the contact arm is fully closed, in FIGS. 9*b* and 9*c* the contact arm is shown moving progressively toward the full open position of FIG. 9*d*, and in FIG,. 9*e* the contact arm is shown in its position of initial engagement between the movable and stationary contacts.

Now referring to the Figures. Circuit breaker 10 is a three-pole unit disposed within a molded insulated housing consisting of shallow base 11 and removable front cover 12 which mate along line 14. Partitions 16, 17 in base 11 extend parallel to sides 18, 19 thereof to divide base 11 into three side-by-side, longitudinally extending compartments each of which contains the current carrying elements of an individual pole. In a manner well known to the art, the center compartment formed between partitions 16, 17 also houses a common trip-free, overcenter toggle type contact operating mechanism 15 which, as will hereinafter be seen, acting through transverse insulating tie bar 21 simultaneously opens and closes all poles of circuit breaker 10 during manual operation and simultaneously opens circuit breaker 10 upon the occurrence of predetermined moderate overloads and moderate short circuits.

Figure 1:
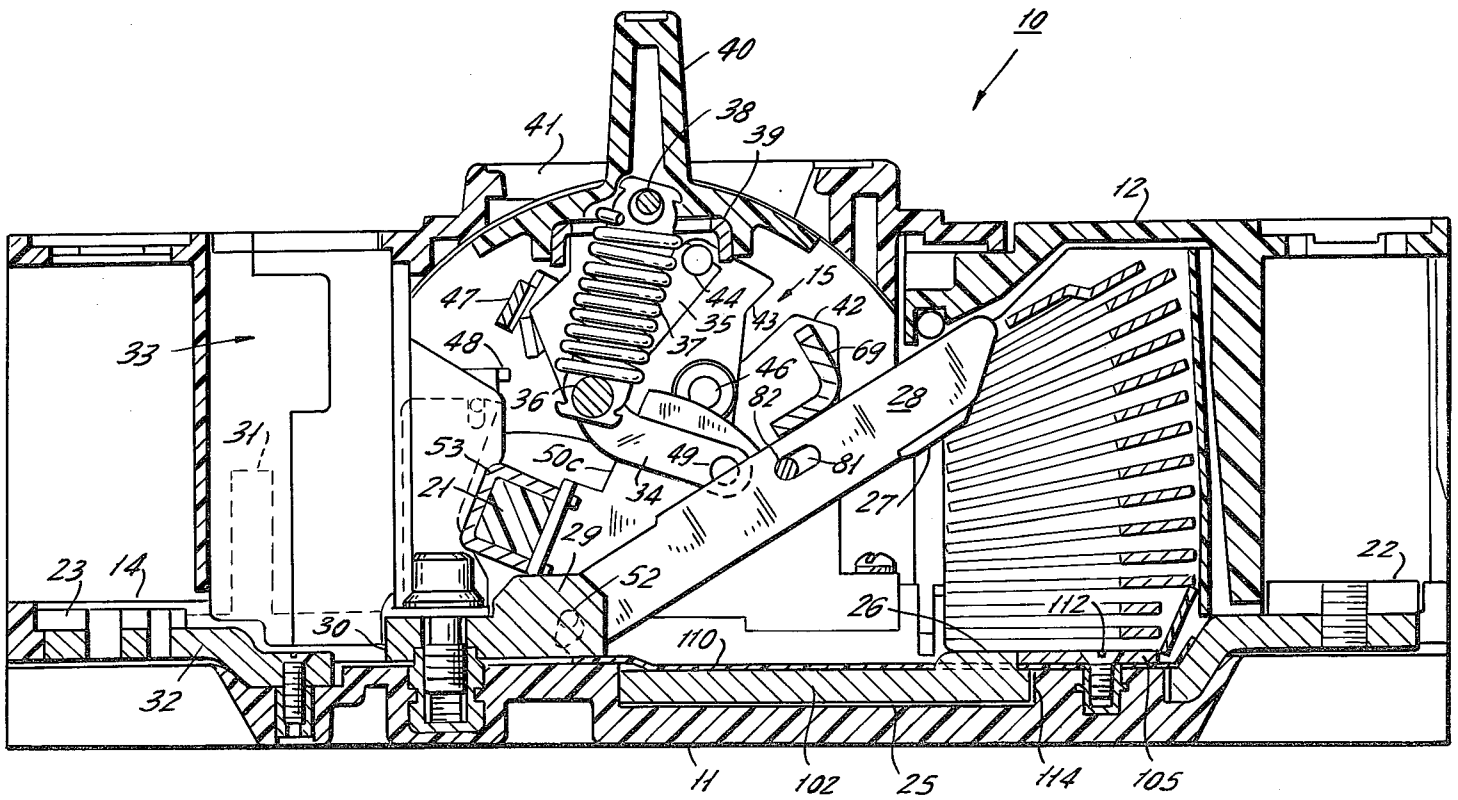
FIG. 1 is a longitudinal cross-section of a molded case circuit breaker that embodies the teachings of the instant invention.
Figure 2:
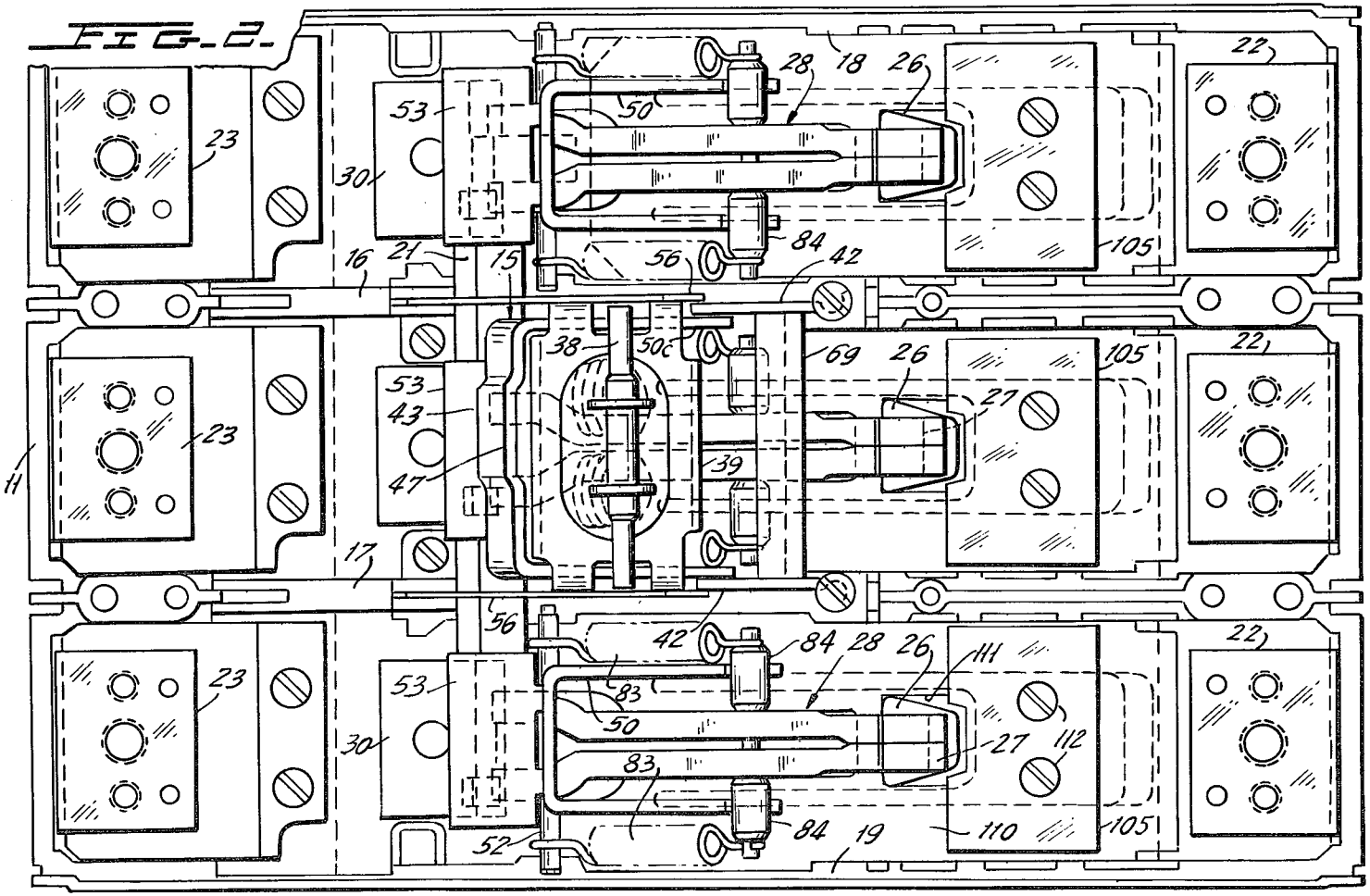
FIG. 2 is a plan view of the circuit breaker of FIG. 1 with the arc chutes, automatic overload trip unit, housing cover and manual operating handle removed to better reveal other elements of the circuit breaker.

Since the current carrying elements of all three poles are essentially identical, the current carrying elements of only one pole shall be described herein with particular reference to FIG. 1. That is, the current path between line terminal 22 and load terminal 23 located at opposite ends of housing 11, 12 comprises terminal strap 25 (FIG. 3), stationary contact 26, movable contact 27, movable contact arm 28, conducting support 29, terminal strap 30 through overload current sensing automatic trip unit 33), and strap 32 having load terminal 23 mounted thereon.

Figures 6, 7, 8:
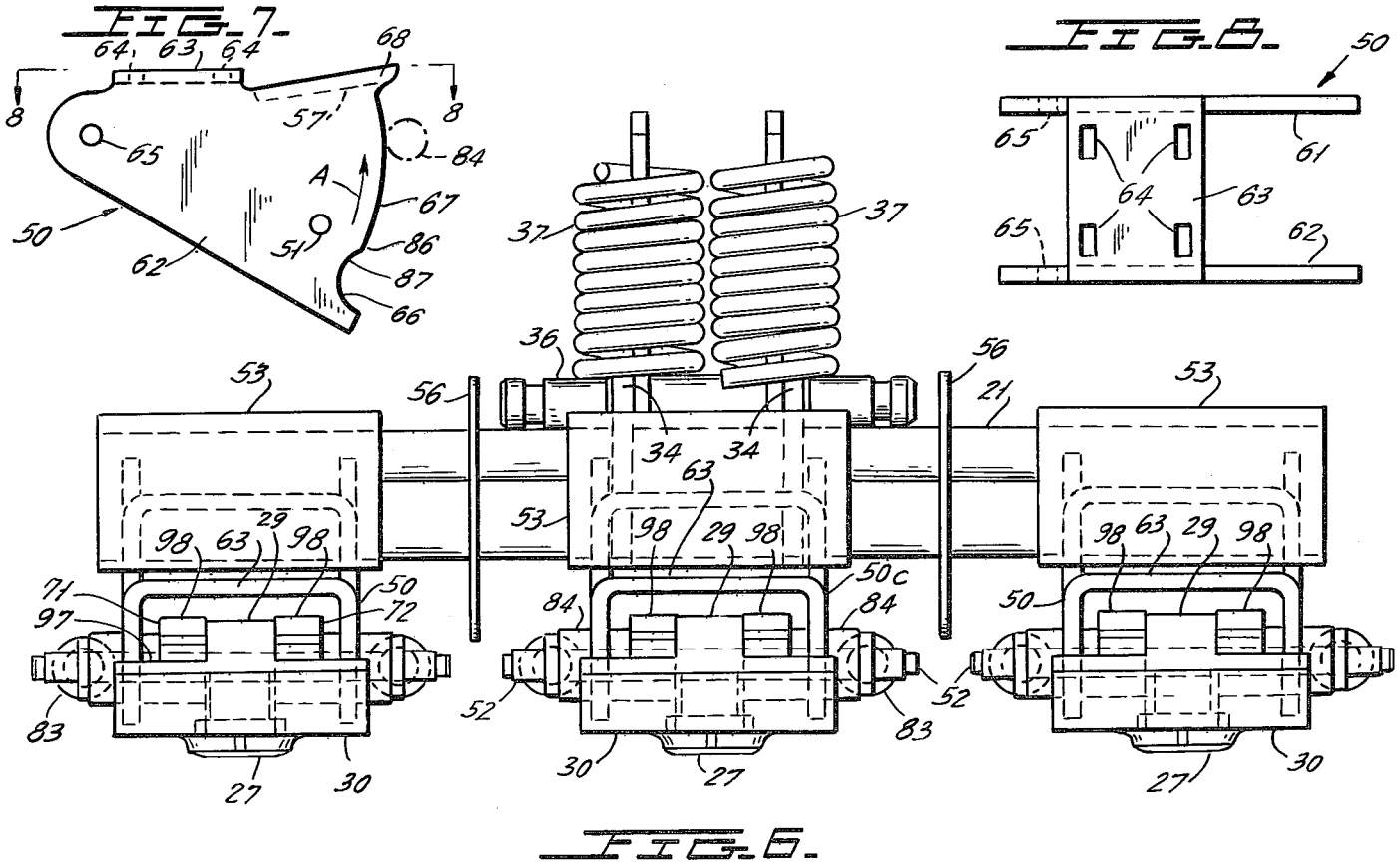
FIG. 6 is an elevation of the elements in FIG. 4, looking in the direction of arrows 6—6.
FIG. 7 is a side elevation of the drive means element for the movable contact arm.
FIG. 8 is an end view of the drive means element, looking in the direction of arrows 8—8 of FIG. 7.

The toggle portion of contact operating mechanism 15 includes lower link 34 and upper link 35 pivotally connected at knee 36. Coiled tension springs 37 are connected between knee 36 and transverse pin 38, the latter being supported by and movable with operating member 39 having insulating handle extension 40 projecting forward of cover 12 through opening 41 therein. A fixed pivot (not shown) on mechanism frame 42 pivotally supports operating member 39. The end of upper toggle link 35 remote from knee 36 is mounted to latchable cradle 43 at pivot 44. Cradle 43 is mounted on frame 42 at pivot 46 and is pivotable about the latter in a counterclockwise direction as viewed in FIG. 1 to bring cradle latching formation 47 into engagement with releasable latch 48 that projects from trip unit 33. The end of lower toggle link 34 remote from knee 36 is connected by pivot 49 to drive means 50*c* at aperture 51 thereof (FIG. 7). At a point remote from pivot 49 drive means 50*c* is pivotally mounted on pin 52 that also provides a pivotal connection between movable contact arm 28 and support 29. When toggle 34, 35 is extended as in FIG. 4, drive means 50*c* is in its Closed position and when toggle 34, 35 is collapsed as in FIG. 1, drive means 50*c* is pivoted counterclockwise about pivot 52 to its Open position of FIG. 1.

U-shaped clamp 53 connects drive means 50*c* to tie rod 21 at the center thereof. Each of the outer poles is provided with a drive means 50., the difference between drive means 50*c* and 50 is that the latter does not have aperture 51 and the former does not have the shaded portion bounded by dash line 57 in FIG. 7. In each of the outer poles, drive means 50 is secured to tie rod 21 outboard of drive means 50*c*. In a manner well known to the art, transverse bar 21 extends through cut-aways in housing partitions 16, 17 that provide large enough apertures for free movement verse bar 21 extends through cut-aways in housing partitions 16, 17 that provide large enough apertures for free movement of bar 21 as drive means 50*c* and 50 pivot between their Open and Closed positions. These partition openings are otherwise covered by insulating sheets 56 mounted on bar 21 and movably positioned adjacent partitions 16, 17.

For the most part, drive means 50*c* and 50 are identical so that only the latter will be described in detail. That is, drive means 50 is a generally U-shaped member having parallel arms 61, 62 connected by web 63 having apertures 64 which receive gripping ears (not shown) extending from clamp 53. Each of the arms 61, 62 is identical so that only arm 62 will be described in detail. Arm 62 includes aperture 65 through which contact arm pivot pin 52 extends. The edge of arm 62 remote from aperture 65 is provided with cam depression 66 and relatively long cam formation 67 adjacent to depression 66. At the end of formation 67 the edge having cam formation 66, 67 is provided with protrusion 68 which, in a manner to be hereinafter explained, limits opening motion of each outer pole contact arm 28 during blow-off. Opening movement of contact arm 28 in the center pole is limited by engagement of that arm 28 with transverse element 69 (FIG. 1) of mechanism frame 42.

Figures 3, 4, 5:
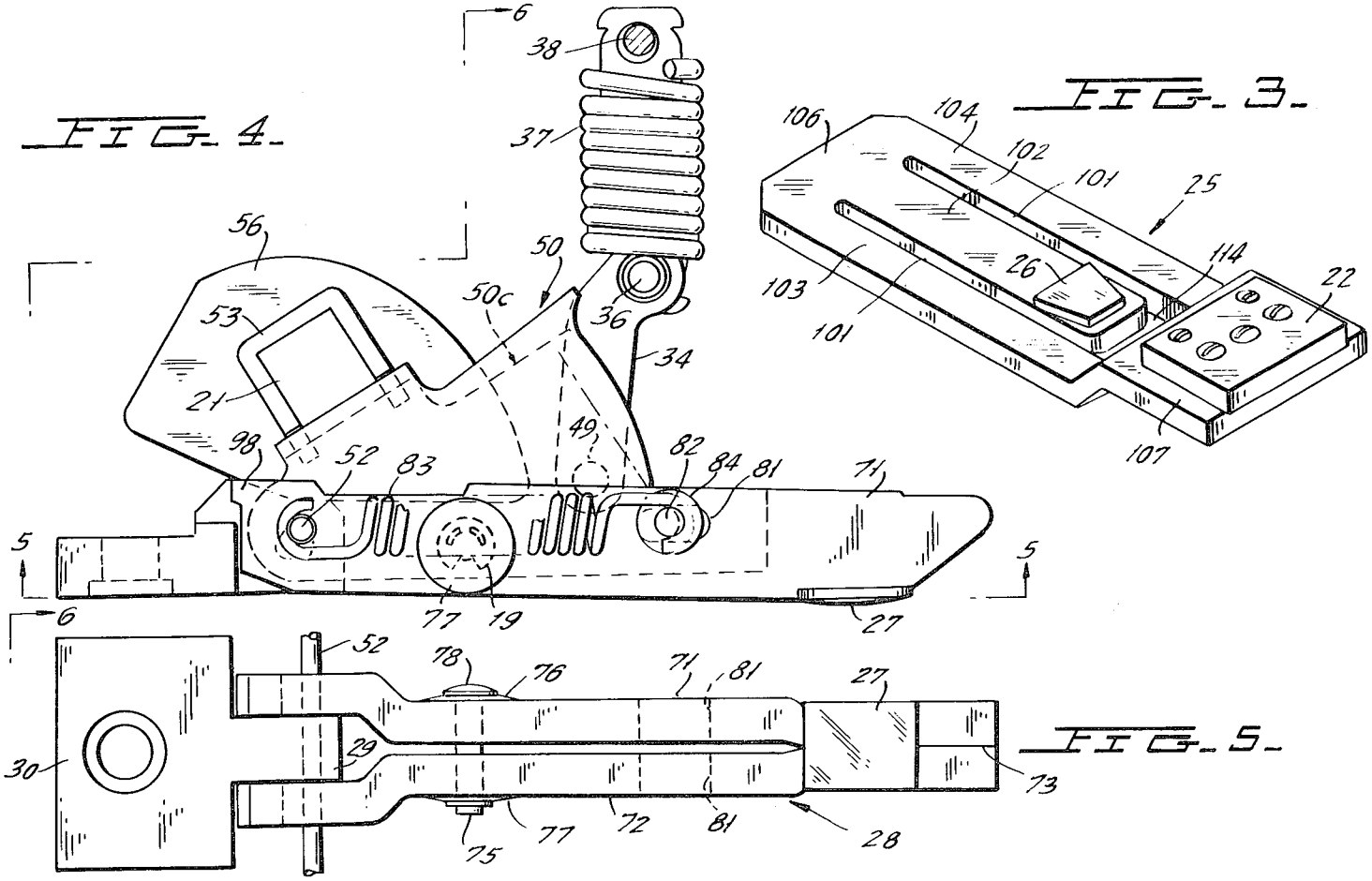
FIG. 3 is a perspective of the conducting strap on which the stationary contact is mounted.
FIG. 4 is a side elevation of the movable contact arm and selected elements in operative engagement therewith.
FIG. 5 is a bottom view of the movable contact arm and its support, looking in the direction of arrows 5—5 of FIG. 4.

As seen best in FIG. 5, movable contact arm 28 includes elongated parallel conducting sections 71, 72 that are closely spaced at the major central portions thereof. At the end of arm 28 having movable contact 27, sections 71, 72 are offset inwardly to abut one another and are firmly secured together as by brazing. At the end of arm 28 remote from contact 27, sections 71, 72 are offset outwardly and receive support 29 therebetween. Sections 71, 72 are biased toward one another by spring washers 76, 77 which lie against opposite sides of arm 28 and are mounted on pin 75 that extends through aligned apertures in sections 71, 72. Head 78 of pin 75 retains spring washer 78 and snap-on clip 79 is received in an annular depression near the end of pin 75 remote from head 78 to retain spring washer 77. The biasing force provided by spring 76, 77 acts to assure firm contact between sections 71, 72 and support 29 regardless of the angular position of contact arm 28.

Currents flowing in sections 71 and 72 of movable contact arm 28 are in the same direction, thereby generating an attracting force which aids the biasing forces generated by spring washers 76, 77. This electrodynamic attracting force is especially stronger in the extensive closely spaced central region between sections 71 and 72. As current flow increases, this electrodynamic force increases and serves to offset the blowoff forces at the interfaces between support 29 and sections 71, 72, with these blowoff forces increasing as current flow increases.

Sections 71, 72 are also provided with aligned longitudinally extending elongated slots 81 through which transverse pin 82 extends. Along the outboard side of each section 71, 72 is a coiled tension spring 83 secured to pivot pin 52 and transverse pin 82. Disposed between spring 83 and each of the sections 71, 72 is a cylindrical cam follower roller 84. Springs 83 bias cam followers 84 toward contact arm pivot 52 and against the surfaces of drive means 50 having cam formations 66, 67.

Under normal operating conditions, followers 84 are in depressions 66 so that as drive means 50 is operated between its Open and Closed positions, contacts 26, 27 will be disengaged and engaged, respectively. However, with contacts 26, 27 engaged, if severe overload current conditions occur, electrodynamic forces acting to separate contacts 26, 27 will move contact arm 28 to its Open position of FIG. 1 before drive means 50 has an opportunity to move from its Closed position toward its Open position. When this occurs, initial movement of contact arm 27 in the circuit opening direction moves followers 84 in the upward direction with respect to FIG. 4 until they leave the cam depressions 66 and arrive at convex cam formations 67. The boundary 86 (FIG. 7) between cam formations 66, 67 is the overcenter position for contact arm 28. That is, when cam follower 84 moving in the contact opening direction indicated by arrow A in FIG. 7 leaves cam depression 66 and moves past point 86, the action of spring 83 biases follower 84 in the direction of arrow A. The curvature of cam formation 67 may be chosen so that for initial movement of follower 84 after it leaves cam depression 66, movement will be rapid. Such movement will slow somewhat as follower 84 approches protrusion 68 so that by the time follower 84 engages protrusion 68, even though it is being biased in the opening position indicated by arrow A, there is no danger that they will move beyond protrusion 68. In addition, the deceleration of follower 84 is such that there is no danger of contact arm 28 rebounding toward closed circuit position after being driven to open circuit position by electrodynamic forces which accompany severe overload currents. Subsequent movement of drive means 50 to its Open position will cause relative movement between drive means 50 and contact arm 28 to bring follower 84 into cam depression 66.

For the most part, cam follower 84 is normally seated in the deepest portion of cam pocket 66. This condition exists during closing movement of contact arm 28, up to the point where there is initial engagement of movable contact 27 with stationary contact 26. However, drive means 50 continues to move in the closing direction (clockwise with respect to FIG. 1) and by so doing, follower 84 is engaged by section 87 of cam depression 66. This forces transverse pin to move slightly away from pivot 52 thereby additionally tensioning springs 83. Even though the line of action of springs 83 is generally longitudinal with respect to contact arm 28, the angular relationship between cam surface portion 87 and follower 84 results in a relatively strong component of force in the contact closing direction.

The shape of cam section 67 is tailored so that during electrodynamic blowoff, as soon as follower 84 moves beyond 86, contact arm 28 is effectively in an overcenter position in the circuit opening direction. It is seen that this latter condition is achieved after relatively little movement of contact arm 28 in the opening direction.

Electrodynamic blowoff forces which open circuit breaker 10 during severe fault current conditions result from interations of the magnetic fields that accompany currents flowing in contact arm 28 and stationary contact strap 25. The latter is stamped from conducting sheet material with the stamping process providing a generally U-shaped cutout that effectively forms three closely spaced elongated arms 102, 103, 104 that are joined by connecting section 106 at the end of strap 25 remote from line terminal 22. Terminal section 107 of strap 25 acts as a jumper between the ends of exterior arms 103, 104 remote from connecting section 106. The cross-sectional areas of exterior arms 103, 104 are essentially equal and the cross-sectional area of interior arm 102 is essentially equal to the combined cross-sectional areas of arms 103 and 104.

With circuit breaker 10 closed, movable contact arm 28, which confronts interior arm 102, is very closely spaced therefrom. The width of contact arm 28 is less than the width of interior arm 102 and the spaces between interior arm 102 and exterior arms 103, 104 are each less than the thickness of the stock from which strap 25 is stamped. Relatively stiff, flexible insulating sheet 110 is interposed between movable contact arm 28 and strap 25, covering most of the latter. Insulator 110 is provided with cutout 111 through which stationary contact 26 extends. Formations within base 11 operatively position strap 25. Arcing contact 105 acts as a clamp to retain strap 25. That is, arc runner 105 is provided with individual clearance apertures for two screws 112 that are received by threaded inserts (not shown) in base 11 after passing through the web portion 114 of U-shaped cutout 101 in strap 25, and clearance apertures in insulator 110 and arc runner 105.

Current entering strap 25 at terminal section 107 flows in the same direction through exterior arms 103, 104, through connecting section 106 and then combine and flow in the opposite direction through interior arm 102. At this time, current flow in movable contact arm 28 is in a direction opposite to the direction of current flow through interior arm 102 so that under severe fault current conditions, a very strong electrodynamic force is generated to repel movable contact arm 28, thereby moving the latter in circuit opening direction. While currents flowing in contact arm 28 and exterior arms 103, 104 are in the same direction, the attractive forces are not significant compared to the repelling forces generated between interior arm 102 and contact arm 28 because of the greater space from arm 28 to arms 103, 104 as compared to the distance between arms 28 and 102. Arm 28 is offset from arms 103 and 104 so that only the attracting components of force in the plane of motion for contact arm 28 that will oppose the repelling force. The attracting forces acting normal to the plane of motion for contact arm 28 are in equal and opposite directions, thereby producing no net effect.

Figure 9B:
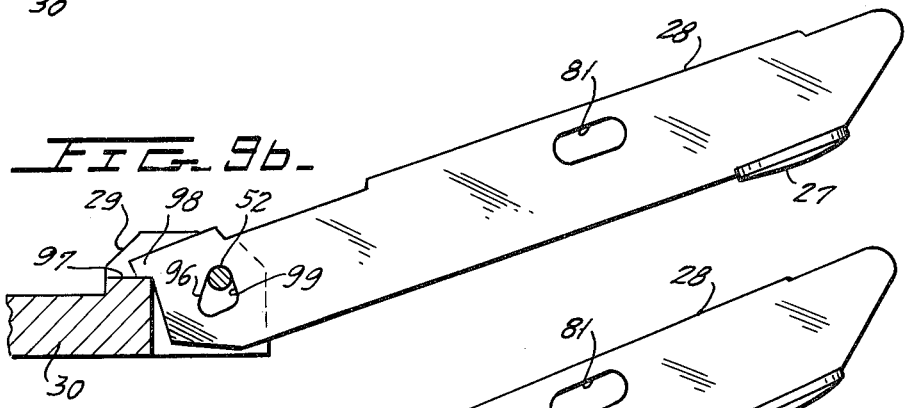
Figure 9C:
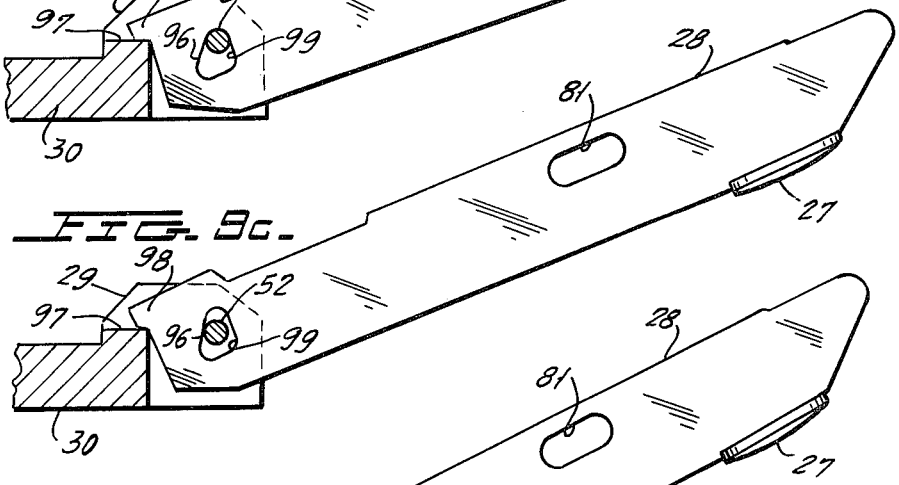
Figure 9D:
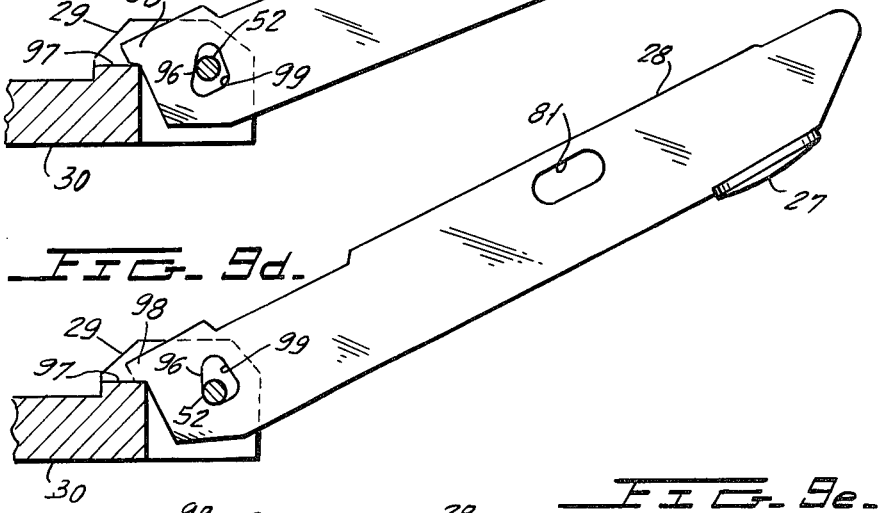
Figure 9E:
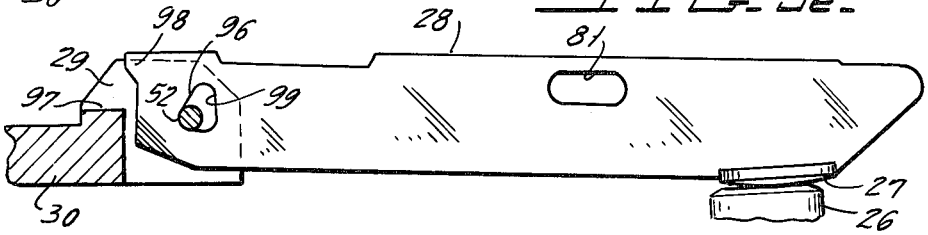

Now referring particularly to FIGS. 9*a* through 9*e*. This axis of contact arm pivot pin 52 is fixed in support 29 and extends through aligned enlarged apertures 99 in contact arm sections 71, 72. In FIG. 9*a*, contacts 26, 27 are shown in their final engaged relationship. Initial opening movement for contact arm 28 takes place about pivot 52 as it is positioned at the upper portion of aperture 99 (FIG. 9*b*). At the outwardly offset portions of contact arm sections 71, 72, each is provided with an ear 98 that is engageable with the upper surface 97 of terminal strap 30. When this engagement occurs, the pivot point for contact arm 28 shifts to ears 98, 98 and the location of pivot 52 within apertures 99 changes (FIG. 9*c*), until in the fully open position of FIG. 9*d*, pin 52 is at the bottom of aperture 99 and adjacent to wall 96 thereof. Pivot 52 remains in this position relative to aperture 99 during the closing motion of contact arm 28 until there is initial engagement between movable contact 27 and stationary contact 26 (FIG. 9*e*). However, there is a continuing downward force being exerted by toggle 34, 35 on drive means 50 which in turn continues to exert a downward force on contact arm 28, causing the latter to pivot slightly about the engaging point between contacts 26 and 27. This causes the opposite end of contact arm 28 to move downward, and in so doing forces aperture wall 96 to ride against pin 52, thereby forcing contact arm 28 to the left with respect to FIG. 9*e* to the final closed position of FIG. 9*a*, thereby causing movable contact 27 to wipe across the upper surface of stationary contact 26.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A circuit breaker including a stationary contact, a movable contact; a contact operating mechanism operatively connected to said movable contact for opening and closing said contacts; said contact operating mechanism including a contact arm on which said movable contact is mounted, drive means mounted for movement between an open and a closed position, a spring powered trip free overcenter toggle means extendable to move said drive means to said closed position and collapsible to move said drive means to said open position; said drive means including cam means having first and second cam formations; a follower mounted to said contact arm; contact pressure spring means urging said follower to engage said cam means; under normal current conditions, said follower being in operative engagement with said first cam formation to form an operative connection between said contact arm and said drive means whereby movement of the latter between said open and closed positions brings said movable contact out of and into engagement, respectively, with said stationary contact; conductor means connected to said stationary contact, disposed lengthwise of said contact arm and positioned adjacent thereto when said contacts are closed, said conductor being operatively connected in circuit with said contact arm for current to flow in opposite directions through said conductor and said contact arm to generate electrodynamic forces tending to open said contacts; under severe current conditions exceeding predetermined overload currents, said electrodynamic forces acting on said contact arm being of sufficient magnitude to overcome force exerted by said spring means and to drive said contact arm in contact opening direction while said drive means remains in said closed position and in so doing move said follower from said first cam section to said second cam section; as said follower passes from said first to said second cam section, said spring means being repositioned to bias said contact arm in contact opening direction and to bias said follower away from said first cam section.

2. A circuit breaker as set forth in claim 1 in which the first cam formation comprises a depression.

3. A circuit breaker as set forth in claim 2 in which the movable contact is mounted near one end of the contact arm; a pivot at the other end of said contact arm about which said contact arm moves to engage and disengage said contacts; means forming a lost motion connection between said follower and said contact arm; said spring means urging said follower longitudinally of said contact arm and toward said pivot.

4. A circuit breaker as set forth in claim 3 in which during closing of said circuit breaker said contacts engage before the drive means has fully reached said closed position; under normal current conditions, with said drive means in said closed position; said follower being engaged with a portion of said first cam formation that produces a substantial component of force derived from force generated by said spring means; said component of force acting through said follower against said contact arm to bias the latter in contact closing direction.

5. A circuit breaker as set forth in claim 4 in which the lost motion connection includes a pin extending transversely through an elongated slot in said contact arm; said follower including first and second roller sections mounted on said pin and positioned at opposite sides of said contact arm; said drive means including first and second parallel sections each containing identical portions of said cam means; said first and second roller sections being biased into engagement with said cam means of said first and second parallel sections, respectively.

6. A circuit breaker as set forth in claim 5 in which the drive means comprises a U-shaped member having spaced parallel arms connected by a web; said parallel sections constituting said arms; and a pivot mounting for said drive means; said pivot mounting being located in the vicinity of the web.

7. A circuit breaker as set forth in claim 6 in which the pivot for the contact arm also constitutes said pivot mounting.

8. A circuit breaker as set forth in claim 7 in which the spring means is a tension means, one end of which is anchored to said pivot mounting.

9. A circuit breaker as set forth in claim 2 in which the second cam formation is shaped to regulate the speed of said contact arm as said follower moves along said second cam formation and away from said first cam formation.

10. A circuit breaker as set forth in claim 1 in which the cam means also includes a third formation; said second formation positioned between said first and third formations; said third formation being operative to decelerate movement of said contact arm in said contact opening direction.

11. A circuit breaker as set forth in claim 1 in which there are first and second side-by-side poles; said first pole including said movable contact, said stationary contact, said conductor, said contact arm, said follower and said drive means; said second pole including another movable contact, another stationary contact, another conductor, another contact arm and another follower of substantially the same construction and operated in substantially the same manner as the respective said movable contact said stationary contact, said conductor, said contact arm and said follower; said second pole also including another drive means having another cam means with another first and another second cam formation; another contact pressure spring means urging said another follower to engage said another cam means; a transverse tie bar to which both said drive means and said another drive means are mounted for simultaneous movement of said drive means and said another drive means to open and closed positions.

* * * * *